US011573501B2

(12) United States Patent
Yamagishi et al.

(10) Patent No.: US 11,573,501 B2
(45) Date of Patent: Feb. 7, 2023

(54) IMAGE FORMING APPARATUS CAPABLE OF CALCULATING SURFACE POTENTIAL OF IMAGE CARRIER BASED ON DEVELOPMENT CURRENT

(71) Applicant: KYOCERA Document Solutions Inc., Osaka (JP)

(72) Inventors: Yoshihiro Yamagishi, Osaka (JP); Tamotsu Shimizu, Osaka (JP); Kazunori Tanaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/474,508

(22) Filed: Sep. 14, 2021

(65) Prior Publication Data

US 2022/0091531 A1 Mar. 24, 2022

(30) Foreign Application Priority Data

Sep. 18, 2020 (JP) ..... JP2020-157411

(51) Int. Cl.
*G03G 15/00* (2006.01)
*G03G 15/06* (2006.01)
*G03G 15/02* (2006.01)

(52) U.S. Cl.
CPC ..... *G03G 15/0266* (2013.01); *G03G 15/065* (2013.01); *G03G 15/5037* (2013.01)

(58) Field of Classification Search
CPC ..... G03G 15/5037; G03G 15/1675
See application file for complete search history.

(56) References Cited

U.S. PATENT DOCUMENTS 7,979,011 B2 * 7/2011 Fujihara ..... G03G 15/065 399/270

FOREIGN PATENT DOCUMENTS

JP 2003-295540 A 10/2003

* cited by examiner

*Primary Examiner* — Arlene Heredia
(74) *Attorney, Agent, or Firm* — IP Business Solutions, LLC

(57) ABSTRACT

An image forming apparatus includes an image carrier, a charging device, a developing device, a transfer device, a development power supply, a current measurement device, and a processor. The development power supply applies a predetermined bias voltage to the developing device. The processor functions as a calculator and a controller. The calculator calculates a surface potential of the image carrier based on the development current measured by the current measurement device. The controller controls the charging device, the developing device, the transfer device, and the development power supply. The controller sets a tentative transfer current to be flowed through the transfer device while the calculator calculates the surface potential.

10 Claims, 11 Drawing Sheets

Fig.7

| | BIAS VOLTAGE [V] | DEVELOPMENT CURRENT [μA] |
|---|---|---|
| LEVEL 1 | 240 | −0.15 |
| LEVEL 2 | 300 | 0.12 |

Fig. 9

PHOTOSENSITIVE DRUM 65A

| TRANSFER CURRENT (μA) | REFERENCE SURFACE POTENTIAL | SURFACE POTENTIAL AFTER 50000 SHEETS | SURFACE POTENTIAL AFTER 100000 SHEETS |
|---|---|---|---|
| 18 | 300 | 300 | 300 |
| 22 | 300 | 285 | 280 |
| 26 | 290 | 275 | 265 |

Fig.10

PHOTOSENSITIVE DRUM 65B

| TRANSFER CURRENT (μA) | REFERENCE SURFACE POTENTIAL | SURFACE POTENTIAL AFTER 50000 SHEETS | SURFACE POTENTIAL AFTER 100000 SHEETS |
|---|---|---|---|
| 18 | 300 | 300 | 300 |
| 22 | 300 | 270 | 260 |
| 26 | 290 | 255 | 235 |

IMAGE FORMING APPARATUS CAPABLE OF CALCULATING SURFACE POTENTIAL OF IMAGE CARRIER BASED ON DEVELOPMENT CURRENT

INCORPORATION BY REFERENCE

This application claims priority to Japanese Patent Application No. 2020-157411 filed on 18 Sep. 2020, the entire contents of which are incorporated by reference herein.

BACKGROUND

The present disclosure relates to image forming apparatuses.

In electrophotographic image forming apparatuses, such as copiers and printers, an image-forming process is widely used in which the surface of a uniformly charged photosensitive drum (image carrier) is exposed to light to form an electrostatic latent image on the surface of the photosensitive drum and a toner is adsorbed to the electrostatic latent image to develop the electrostatic latent image as a toner image. In order to obtain a high-quality image, it is required to perform development by applying a developing bias having an appropriate potential difference from the surface potential of the photosensitive drum.

For the above reason, it is necessary to detect the actual surface potential of the photosensitive drum during image formation. Conventionally, the surface potential of the photosensitive drum has been detected with a surface potential sensor.

However, the surface potential sensor is expensive and has a problem that when scattered toner or the like adheres to the sensor, the sensor cannot accurately measure the surface potential. To cope with this, general techniques are proposed for determining the surface potential of a photosensitive drum without the use of any expensive sensor, such as a surface potential sensor.

For example, a technique is proposed in which a pulsed electrostatic potential pattern is formed on a photo conductor, a bias is applied to a developing roller, and an electric current flowing from the photo conductor into the developing roller during development of the electrostatic potential pattern is measured to obtain the surface potential of the photo conductor. Specifically, the surface potential of the photo conductor is estimated by monitoring the electric current at a point in time when the electrostatic potential in the pulsed electrostatic potential pattern is switched. Thus, the surface potential of the photo conductor can be obtained without the use of a surface potential sensor.

SUMMARY

A technique improved over the aforementioned technique is proposed as one aspect of the present disclosure.

An image forming apparatus according to an aspect of the present disclosure includes an image carrier, a charging device, a developing device, a transfer device, a development power supply, a current measurement device, and a processor. The image carrier allows an electrostatic latent image to be formed on a surface thereof. The charging device charges the image carrier. The developing device supplies a toner on the image carrier and develops the electrostatic latent image formed on the image carrier to form a toner image. The transfer device transfers the toner image formed by the developing device to a recording medium. The development power supply applies a predetermined bias voltage to the developing device. The current measurement device measures a development current flowing through the developing device. The processor executes a control program to function as a calculator and a controller. The calculator calculates a surface potential of the image carrier based on the development current measured by the current measurement device. The controller controls the charging device, the developing device, the transfer device, and the development power supply. The controller sets a tentative transfer current to be flowed through the transfer device while the calculator calculates the surface potential.

BRIEF DESCRIPTION OF THE DRAWINGS

FIG. 7 is a table showing development currents measured when two levels of bias voltage have been applied to a developing roller in an example of the present disclosure.

FIG. 9 is a table showing changes with time of the surface potential of a photosensitive drum in the example.

FIG. 10 is a table showing changes with time of the surface potential of another photosensitive drum of the same type as the above photosensitive drum.

DETAILED DESCRIPTION

Hereinafter, a description will be given of an embodiment of the present disclosure with reference to the drawings. Throughout the drawings, the same or corresponding parts are designated by the same references and further explanation thereof will be omitted.

Figure 1:
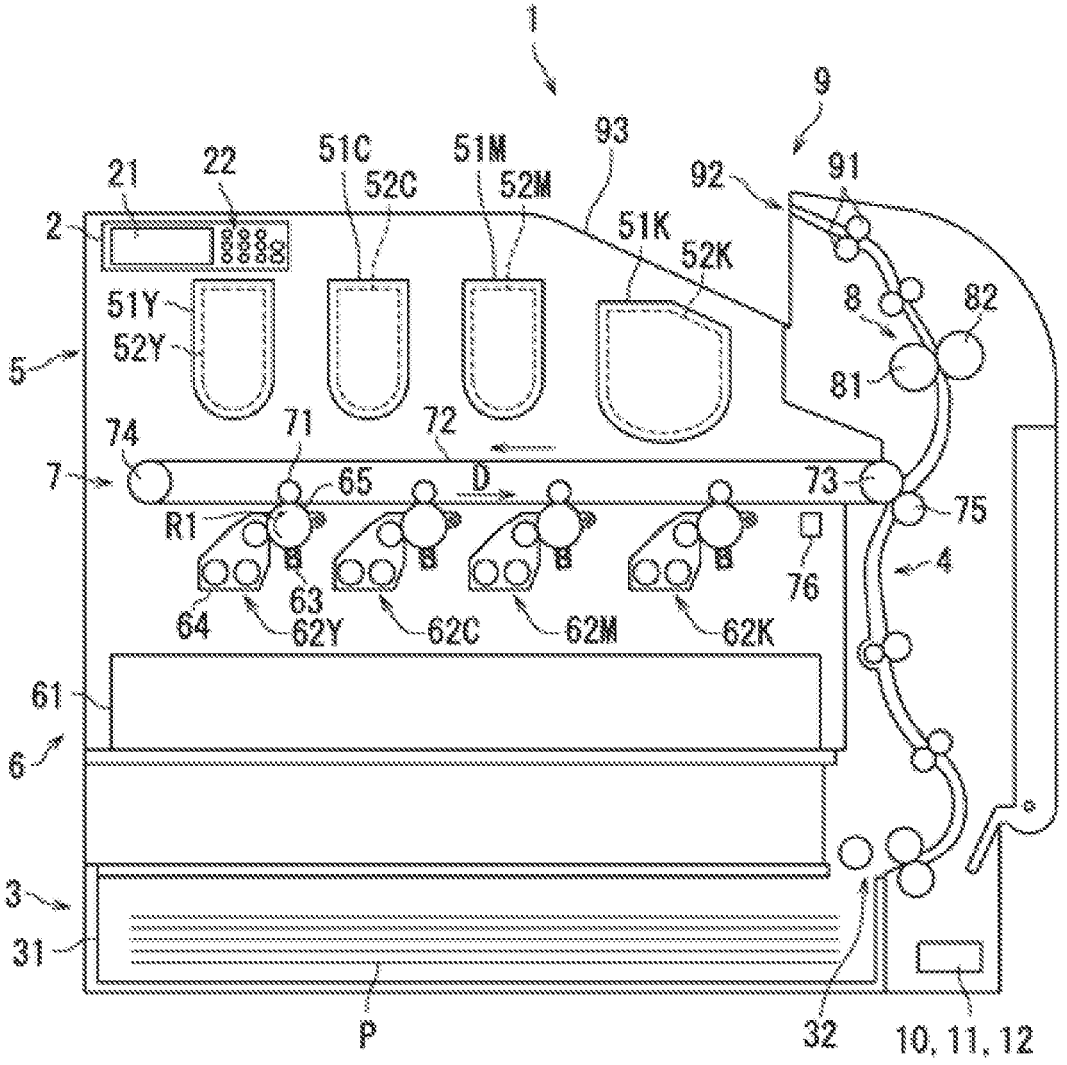
FIG. 1 is a view showing an example of a structure of an image forming apparatus.

Referring to FIG. 1, a description will be given of the structure of an image forming apparatus 1 according to an embodiment of the present disclosure. FIG. 1 is a view showing an example of the structure of the image forming apparatus 1. The image forming apparatus 1 is, for example, a tandem color printer.

As shown in FIG. 1, the image forming apparatus 1 includes an operation device 2, a sheet feed device 3, a conveyance device 4, a toner supply device 5, an image forming device 6, a transfer device 7, a fixing device 8, a sheet output device 9, and a control device 10.

The operation device 2 accepts an instruction from a user. When accepting an instruction from the user, the operation device 2 sends a signal showing the user's instruction to the control device 10. The operation device 2 includes a liquid crystal display 21 and a plurality of operating keys 22. The liquid crystal display 21 displays, for example, various types of processing results. The operating keys 22 include, for example, a numeric keypad and a Start key. When an instruction showing execution of image formation processing is input to the operation device 2, the operation device 2 sends a signal showing execution of the image formation processing to the control device 10. As a result, the control device 10 starts an image-forming operation of the image forming apparatus 1.

The sheet feed device 3 includes a sheet feed cassette 31 and a set of sheet feed rollers 32. The sheet feed cassette 31 is capable of accommodating a plurality of sheets P. The set of sheet feed rollers 32 feed the sheets P accommodated in the sheet feed cassette 31 to the conveyance device 4 sheet by sheet. The sheet P is an example of a recording medium.

The conveyance device 4 includes rollers and guide members. The conveyance device 4 extends from the sheet feed device 3 to the sheet output device 9. The conveyance device 4 conveys a sheet P from the sheet feed device 3 via the image forming device 6 and the fixing device 8 to the sheet output device 9.

The toner supply device 5 supplies a toner to the image forming device 6. The toner supply device 5 includes a first loading device 51Y, a second loading device 51C, a third loading device 51M, and a fourth loading device 51K. The toner supply device 5 is an example of a developer supply device. The toner is an example of a developer.

A first toner container 52Y is loaded into the first loading device 51Y. Likewise, a second toner container 52C, a third toner container 52M, and a fourth toner container 52K are loaded into the second loading device 51C, the third loading device 51M, and the fourth loading device 51K, respectively. The structures of the first to fourth loading devices 51Y to 51K are different only in the type of toner container loaded from each other and the rest of the structures are the same. Therefore, the first to fourth loading devices 51Y to 51K may be referred to collectively as a "loading device 51".

Each of the first toner container 52Y, the second toner container 52C, the third toner container 52M, and the fourth toner container 52K accommodates a toner. In this embodiment, the first toner container 52Y accommodates a yellow toner. The second toner container 52C accommodates a cyan toner. The third toner container 52M accommodates a magenta toner. The fourth toner container 52K accommodates a black toner.

The image forming device 6 includes an exposure device 61, a first image forming unit 62Y, a second image forming unit 62C, a third image forming unit 62M, and a fourth image forming unit 62K.

Each of the first to fourth image forming units 62Y to 62K includes a charging device 63, a developing device 64, and a photosensitive drum 65. The photosensitive drum 65 is an example of an image carrier.

The charging device 63 and the developing device 64 are disposed along the peripheral surface of the photosensitive drum 65. In this embodiment, the photosensitive drum 65 rotates in a direction (clockwise) indicated by the arrow R1 in FIG. 1.

The charging device 63 uniformly charges the photosensitive drum 65 with a predetermined polarity by electric discharge. In this embodiment, the charging device 63 charges the photosensitive drum 65 with a positive polarity. The exposure device 61 irradiates the charged photosensitive drum 65 with laser light. Thus, an electrostatic latent image is formed on the surface of the photosensitive drum 65.

The developing device 64 develops the electrostatic latent image formed on the surface of the photosensitive drum 65 to form a toner image. The developing device 64 is supplied with a toner from the toner supply device 5. The developing device 64 feeds to the surface of the photosensitive drum 65 the toner supplied from the toner supply device 5. As a result, a toner image is formed on the surface of the photosensitive drum 65.

In this embodiment, the developing device 64 included in the first image forming unit 62Y is connected to the first loading device 51Y. Therefore, a yellow toner is supplied to the developing device 64 included in the first image forming unit 62Y. As a result, a yellow toner image is formed on the surface of the photosensitive drum 65 included in the first image forming unit 62Y.

The developing device 64 included in the second image forming unit 62C is connected to the second loading device 51C. Therefore, a cyan toner is supplied to the developing device 64 included in the second image forming unit 62C. As a result, a cyan toner image is formed on the surface of the photosensitive drum 65 included in the second image forming unit 62C.

The developing device 64 included in the third image forming unit 62M is connected to the third loading device 51M. Therefore, a magenta toner is supplied to the developing device 64 included in the third image forming unit 62M. As a result, a magenta toner image is formed on the surface of the photosensitive drum 65 included in the third image forming unit 62M.

The developing device 64 included in the fourth image forming unit 62K is connected to the fourth loading device 51K. Therefore, a black toner is supplied to the developing device 64 included in the fourth image forming unit 62K. As a result, a black toner image is formed on the surface of the photosensitive drum 65 included in the fourth image forming unit 62K.

The transfer device 7 transfers to a sheet P the respective toner images formed on the respective surfaces of the photosensitive drums 65 included in the first to fourth image forming units 62Y to 62K so that the toner images are deposited one over another on the sheet P. In this embodiment, the transfer device 7 transfers the toner images to the sheet P in a manner that the toner images are deposited one over another on the sheet P by the secondary transfer method. Specifically, the transfer device 7 includes four primary transfer rollers 71, an intermediate transfer belt 72, a drive roller 73, a driven roller 74, a secondary transfer roller 75, and a density sensor 76.

The intermediate transfer belt 72 is an endless belt mounted around the four primary transfer rollers 71, the drive roller 73, and the driven roller 74. The intermediate transfer belt 72 is driven according to the rotation of the drive roller 73. In FIG. 1, the intermediate transfer belt 72 travels around counterclockwise. The driven roller 74 is driven into rotation according to the travel of the intermediate transfer belt 72.

The first to fourth image forming units 62Y to 62K are arranged along a direction D of travel of the underside surface of the intermediate transfer belt 72 and facing to the underside surface of the intermediate transfer belt 72. In this embodiment, the first to fourth image forming units 62Y to 62K are arranged in order with the first image forming unit 62Y first, the second image forming unit 62C second, the third image forming unit 63M third, and the fourth image forming unit 63K last from upstream toward downstream in the direction D of travel of the underside surface of the intermediate transfer belt 72.

Each of the primary transfer rollers 71 is disposed facing to the associated photosensitive drum 65 with the intermediate transfer belt 72 in between and pressed toward the associated photosensitive drum 65. Therefore, respective toner images formed on the surfaces of the photosensitive drums 65 are sequentially transferred to the intermediate transfer belt 72.

In this embodiment, a yellow toner image, a cyan toner image, a magenta toner image, and a black toner image are transferred in this order to the intermediate transfer belt 72 so that they are deposited one over another on the intermediate transfer belt 72. Hereafter, the toner image formed by depositing the yellow toner image, the cyan toner image, the magenta toner image, and the black toner image one over another may be referred to also as a "layered toner image".

The secondary transfer roller 75 is disposed facing to the drive roller 73 with the intermediate transfer belt 72 in between. The secondary transfer roller 75 is pressed toward the drive roller 73. Thus, a transfer nip is formed between the secondary transfer roller 75 and the drive roller 73. When a sheet P passes through the transfer nip, the layered toner image on the intermediate transfer belt 72 is transferred to the sheet P. In this embodiment, the yellow toner image, the cyan toner image, the magenta toner image, and the black toner image are transferred to the sheet P so that they form upper to lower layers in this order on the sheet P. The sheet P with the layered toner image transferred thereto is conveyed toward the fixing device 8 by the conveyance device 4.

The density sensor 76 is disposed facing to the intermediate transfer belt 72 and downstream of the first to fourth image forming units 62Y to 62K in the direction D of travel. The density sensor 76 measures the density of the layered toner image formed on the intermediate transfer belt 72. However, the density sensor 76 may measure the densities of the toner images on the photosensitive drums 65 or the density of the layered toner image fixed on the sheet P.

The fixing device 8 includes a heating member 81 and a pressing member 82. The heating member 81 and the pressing member 82 are disposed facing to each other to form a fixing nip. When the sheet P conveyed from the image forming device 6 passes through the fixing nip, it is pressed while being heated at a predetermined fixing temperature. As a result, the layered toner image is fixed on the sheet P. The sheet P is conveyed from the fixing device 8 toward the sheet output device 9 by the conveyance device 4.

The sheet output device 9 includes a pair of sheet output rollers 91 and a sheet output tray 93. The pair of sheet output rollers 91 convey the sheet P via a sheet output opening 92 to the sheet output tray 93. The sheet output opening 92 is formed in an upper portion of the image forming apparatus 1.

The control device 10 controls the operations of the components included in the image forming apparatus 1. The control device 10 includes a processor 11 and a storage device 12. The processor 11 includes, for example, a CPU (central processing unit). The storage device 12 includes a memory, such as a semiconductor memory, or may include an HDD (hard disk drive). The storage device 12 holds a control program. The processor 11 executes the control program to control the operations of the image forming apparatus 1.

Figure 2:
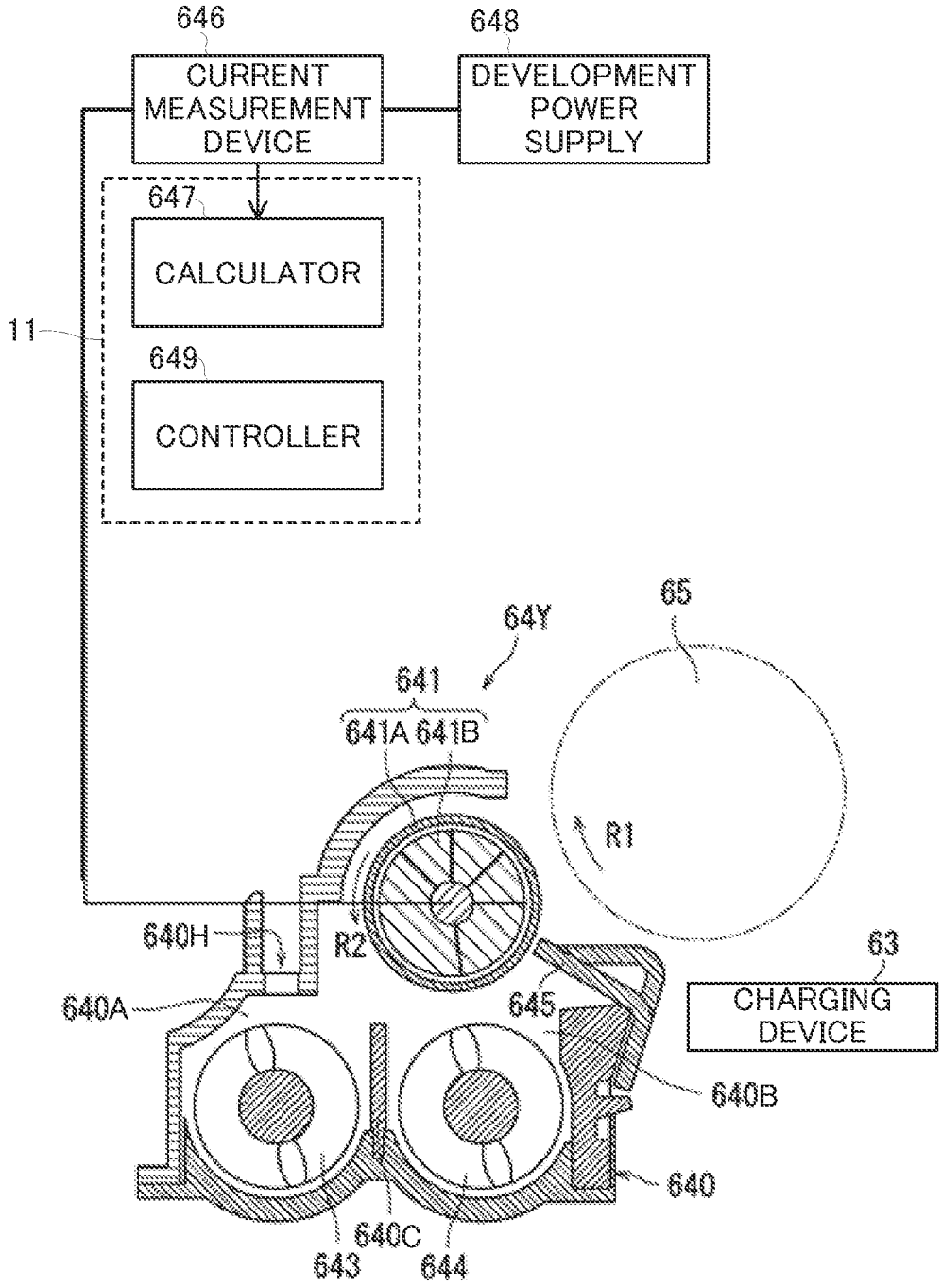
FIG. 2 is a view showing an example of a structure of a developing device.

Next, a description will be given in detail of the structure of the developing device 64 with reference to FIG. 2. FIG. 2 is a view showing an example of the structure of the developing device 64. Specifically, FIG. 2 shows a first developing device 64Y included in the first image forming unit 62Y. In FIG. 2, the photosensitive drum 65 is shown by the dash-double-dot-line for ease of understanding. In this embodiment, the first developing device 64Y develops an electrostatic latent image formed on the surface of the photosensitive drum 65 in a two-component development system. As already described with reference to FIG. 1, a development container 640 of the first developing device 64Y is connected to the first toner container 52Y. Therefore, the development container 640 of the first developing device 64Y is supplied through a toner supply opening 640H with a yellow toner.

As shown in FIG. 2, the first developing device 64Y contains, in the interior of the development container 640, a developing roller 641, a first stirring screw 643, a second stirring screw 644, and a blade 645. Specifically, the developing roller 641 is disposed facing to the second stirring screw 644. The blade 645 is disposed facing to the developing roller 641.

The development container 640 is divided into a first stirring chamber 640A and a second stirring chamber 640B by a partition wall 640C. The partition wall 640C extends in the axial direction of the developing roller 641. The first stirring chamber 640A and the second stirring chamber 640B are communicated with each other laterally of both longitudinal ends of the partition wall 640C.

The first stirring screw 643 is placed in the first stirring chamber 640A. A magnetic carrier is contained in the first stirring chamber 640A. The first stirring chamber 640A is supplied through the toner supply opening 640H with a non-magnetic toner. In the example shown in FIG. 2, the first stirring chamber 640A is supplied with a yellow toner.

The second stirring screw 644 is placed in the second stirring chamber 640B. A magnetic carrier is contained in the second stirring chamber 640B.

The yellow toner is stirred by the first stirring screw 643 and the second stirring screw 644 and thus mixed with the carrier. As a result, a two-component developer made of the carrier and the yellow toner is formed. The two-component developer is an example of a developer and, therefore, may hereinafter be referred to simply as a "developer".

The first stirring screw 643 and the second stirring screw 644 stir the developer while circulating it between the first stirring chamber 640A and the second stirring chamber 640B. As a result, the toner is charged with a predetermined polarity. In this embodiment, the toner is charged with a positive polarity.

The developing roller 641 is composed of a non-magnetic rotary sleeve 641A and a magnetic body 641B. The magnetic body 641B is stationarily disposed in the interior of the rotary sleeve 641A. The magnetic body 641B includes a plurality of magnetic fields. The developer is adsorbed to the developing roller 641 by a magnetic force of the magnetic body 641B. As a result, a magnetic brush is formed on the surface of the developing roller 641.

In this embodiment, the developing roller 641 rotates in the direction (counterclockwise) indicated by the arrow R2 in FIG. 2. When rotating, the developing roller 641 conveys the magnetic brush to a location where the magnetic brush faces to the blade 645. The blade 645 is disposed so that a gap is formed between the blade 645 and the developing roller 641. Therefore, the thickness of the magnetic brush is defined by the blade 645. The blade 645 is disposed upstream of the location where the developing roller 641 and the photosensitive drum 65 face to each other in the direction of rotation of the developing roller 641.

A predetermined voltage is applied to the developing roller 641. Thus, a developer layer formed on the surface of the developing roller 641 is conveyed to the location where it faces to the photosensitive drum 65, so that a toner in the developer is adsorbed to the photosensitive drum 65.

Specifically, the first developing device 64Y further includes a current measurement device 646 and a development power supply 648. Furthermore, the processor 11 executes the control program to function as a calculator 647 and a controller 649.

The current measurement device 646 is connected, for example, between the development power supply 648 and the developing roller 641. The development power supply 648 applies a predetermined bias voltage to the developing roller 641 of the first developing device 64Y. The current measurement device 646 detects, according to the bias voltage applied by the development power supply 648, a development current flowing between the photosensitive drum 65 and the developing roller 641. The current measurement device 646 is formed of, for example, an ammeter. The current measurement device 646 measures the electric current value of the development current.

Figure 3A:
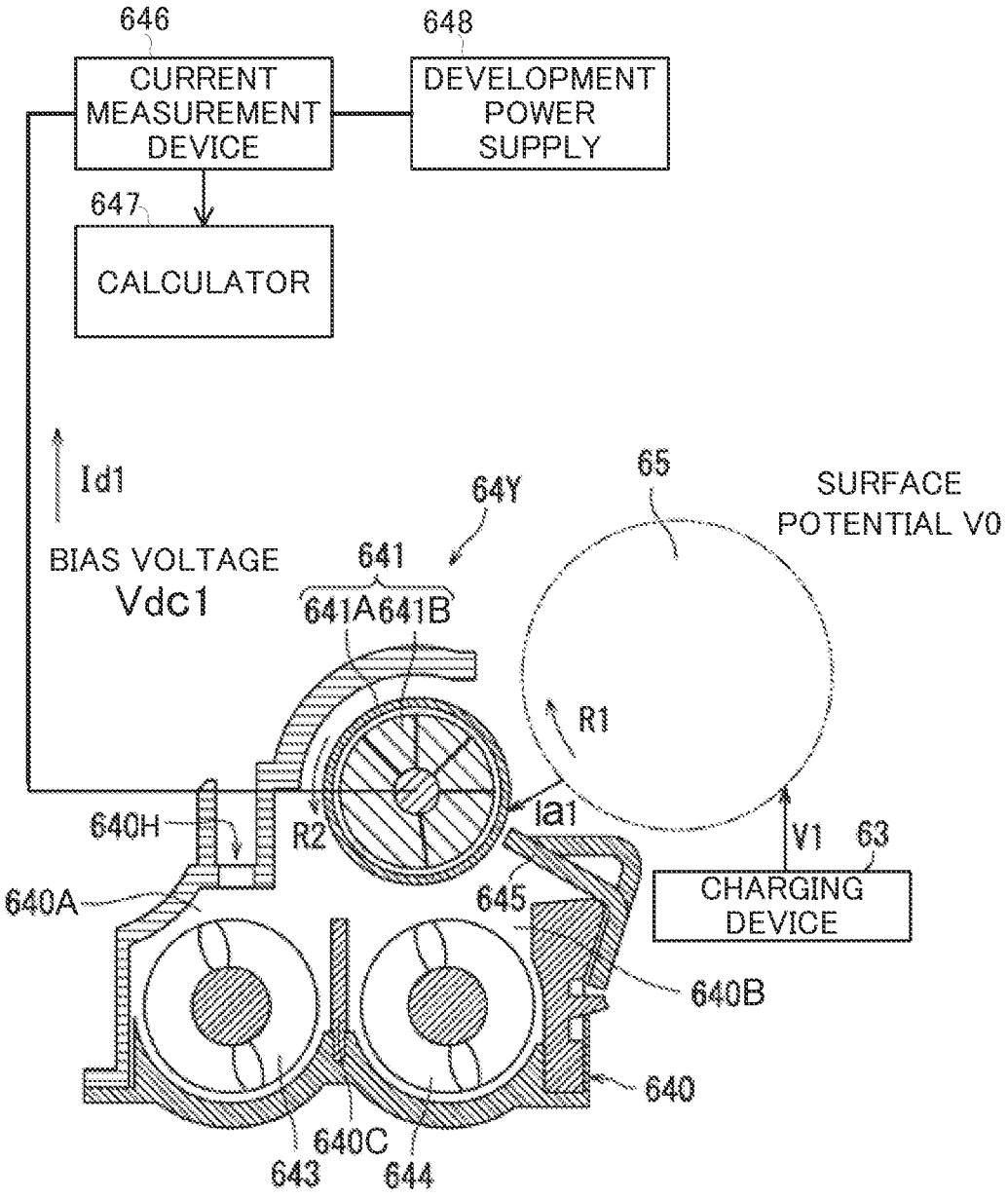
FIG. 3A is a view showing an example of a development current.
Figure 3B:
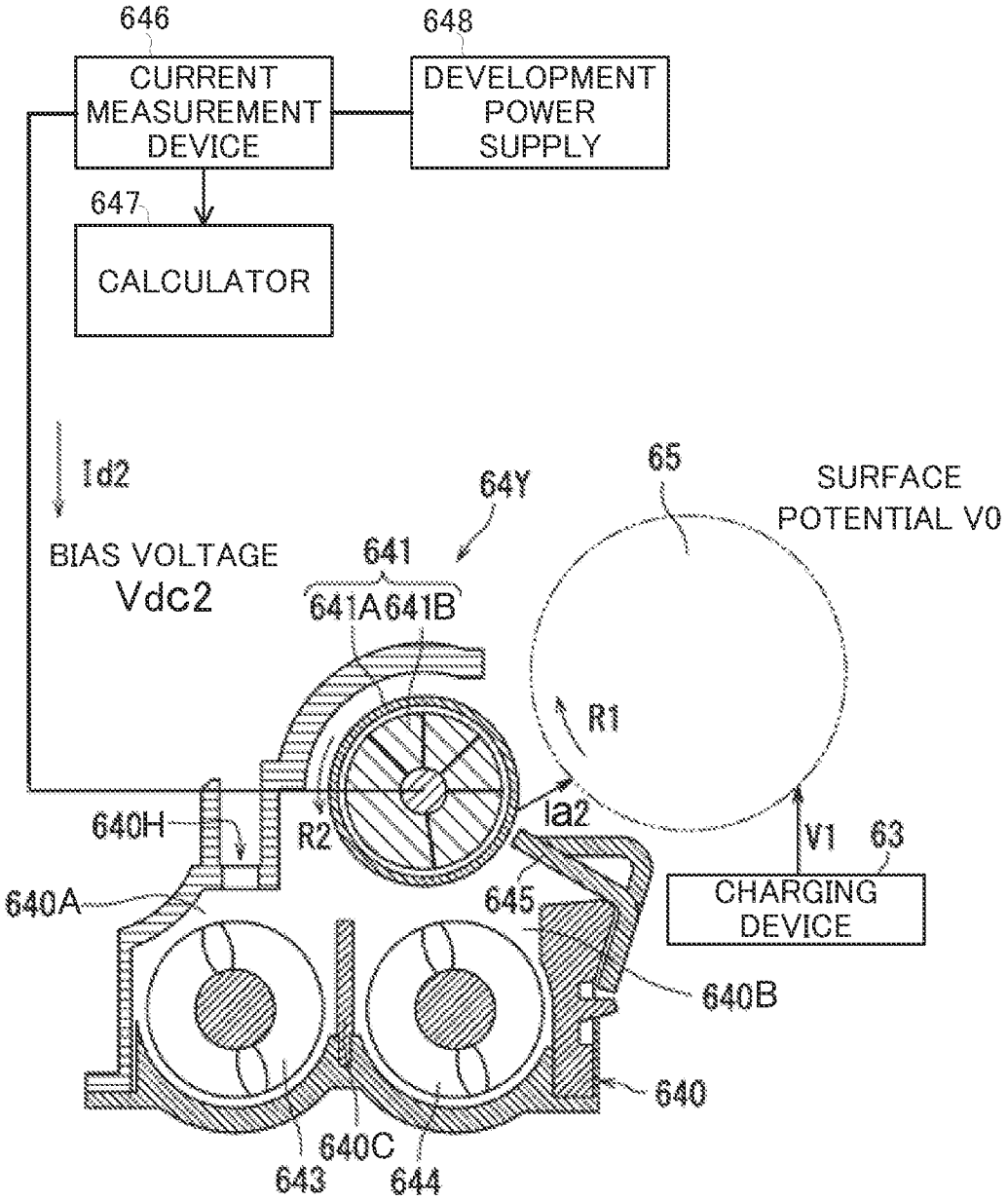
FIG. 3B is a view showing another example of a development current.

Next, a description will be given of the development current flowing through the first developing device 64Y with reference to FIGS. 3A and 3B. FIGS. 3A and 3B are views showing development currents measured by the current measurement device 646.

For example, the current measurement device 646 measures the electric current value of the development current while the first developing device 64Y develops an electrostatic latent image formed on the surface of the photosensitive drum 65.

In this embodiment, when a user's instruction to execute image formation processing is input to the image forming apparatus 1, the controller 649 controls the image forming device 6 to allow the components included in the image forming device 6 to start their image-forming operations. Specifically, the controller 649 controls the charging device 63, the first developing device 64Y, the development power supply 648, the exposure device 61, and so on.

Under the control of the controller 649, the charging device 63 charges the surface of the photosensitive drum 65 with a predetermined charge potential (surface potential V0). Specifically, when the charging device 63 applies a charging bias to the photosensitive drum 65, the surface of the photosensitive drum 65 is charged with the surface potential V0.

Under the control of the controller 649, the development power supply 648 applies a bias voltage to the developing roller 641. The bias voltage contains a DC component and an AC component. FIG. 3A shows the case where a bias voltage having a smaller magnitude (Vdc1) of the DC component than the surface potential V0 has been applied to the developing roller 641. However, the bias voltage need not necessarily contain an AC component.

Under the control of the controller 649, the exposure device 61 applies laser light to the photosensitive drum 65 charged with the surface potential V0 by the charging device 63. Thus, an electrostatic latent image is formed on the surface of the photosensitive drum 65.

When the electrostatic latent image is formed on the surface of the photosensitive drum 65, the first developing device 64Y develops, under the control of the controller 649, the electrostatic latent image formed on the surface of the photosensitive drum 65.

During the above development, the current measurement device 646 measures the electric current value of the development current. In FIG. 3A, the development current Id1 is a total electric current of an electric current flowing through when the toner in the magnetic brush formed on the developing roller 641 moves to the photosensitive drum 65 and an electric current Ia1 flowing into via the magnetic brush formed on the developing roller 641 from the photosensitive drum 65.

On the other hand, FIG. 3B shows the case where a bias voltage having a larger magnitude (Vdc2) of the DC component than the surface potential V0 has been applied to the developing roller 641. In FIG. 3B, the development current Id2 is a total electric current of an electric current Ia2 flowing through when the toner is developed onto the photosensitive drum 65 and an electric current flowing via the magnetic brush formed on the developing roller 641 into the photosensitive drum 65.

As seen from the figures, the direction of the development current measured by the current measurement device 646 when the DC component of the bias voltage is larger than the surface potential V0 is opposite to that when the DC component of the bias voltage is smaller than the surface potential V0.

Furthermore, when the DC component of the bias voltage is equal to the surface potential V0, the development field strength becomes zero and the magnitude of the development current is zero. It can be expected from this that the DC component of the bias voltage when the magnitude of the development current is zero is the surface potential V0.

Figure 4:
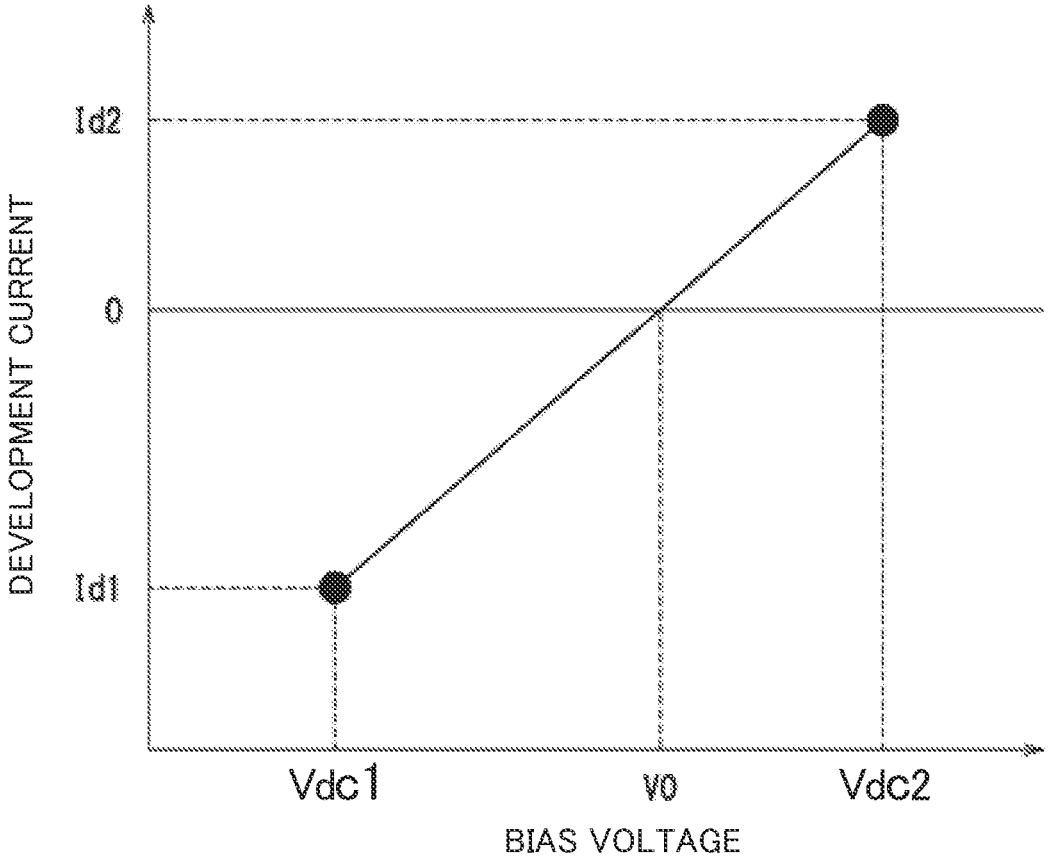
FIG. 4 is a graph showing a correspondence between development current and bias voltage.

Next, a description will be given of the calculation of the surface potential with reference to FIGS. 3 and 4. FIG. 4 is a graph showing a correspondence between development current and bias voltage. In FIG. 4, the development current is put on the vertical axis and the bias voltage is put on the horizontal axis.

For example, the development power supply 648 applies a bias voltage Vdc1 to the developing roller 641. During the above application of bias voltage, the current measurement device 646 measures the electric current value of the development current Id1. The calculator 647 acquires the bias voltage Vdc1 being applied by the development power supply 648 and the electric current value of the development current Id1 measured by the current measurement device 646 (see FIG. 3A).

Furthermore, the development power supply 648 applies a bias voltage Vdc2 to the developing roller 641. During the above application of bias voltage, the current measurement device 646 measures the electric current value of the development current Id2. The calculator 647 acquires the bias voltage Vdc2 being applied by the development power supply 648 and the electric current value of the development current Id2 measured by the current measurement device 646 (see FIG. 3B).

Based on the acquired values of the bias voltage Vdc1 and the development current Id1 and values of the bias voltage Vdc2 and the development current Id2, the calculator 647 calculates as the surface potential V0 a bias voltage at which no development current flows.

In this embodiment, the structures of the respective developing devices 64 included in the first to fourth image forming units 62Y to 62K are different only in the type of toner supplied from the toner supply device 5 from each other and the rest of the structures are the same. Therefore, further explanation of the structures of the second to fourth developing devices 64C to 64K included in the second to fourth image forming units 62C to 62K will be accordingly omitted.

In the photosensitive drum 65, the history of transfer current It having flowed through the transfer device 7 (fed to the transfer rollers 71, 75) remains in a photosensitive layer inside of the photosensitive drum 65, so that a phenomenon (a transfer memory) occurs in which the calculated surface potential decreases. For example, a transfer memory often occurs in organic photo conductors (OPC).

Furthermore, the transfer memory tends to more significantly occur when the photosensitive drum 65 is deteriorated, such as a reduction in film thickness of the photosensitive drum 65, contamination of the surface thereof or optical fatigue of the surface thereof.

To cope with the above problem, in this embodiment, changes with time of the surface potential V0 are observed to determine whether or not a transfer memory is occurring, and the determination result is utilized for efficient maintenance of the image forming apparatus 1.

[First Determination Method]

Specifically, the calculator 647 calculates the surface potential V0 at predetermined time intervals. For example, when the power is first switched on after the photosensitive drum 65 is replaced, the calculator 647 calculates the surface potential V0 in the manner as shown in FIGS. 3A, 3B, and 4. The controller 649 acquires the surface potential V0 calculated by the calculator 647. The controller 649 allows, for example, the storage device 12 to store and retain the acquired surface potential V0 as a reference surface potential.

In this embodiment, during calculation of the surface potential V0 by the calculator 647, the controller 649 sets a tentative transfer current, for example, larger than a transfer current It during normal image formation processing. Alternatively, the controller 649 may set a tentative transfer current having the same magnitude as the transfer current It.

Thereafter, for example, in accordance with an input indicating an instruction to execute image formation processing from the user, the controller 649 controls the components of the image forming apparatus 1 to allow them to subject a plurality of sheets P to the image formation processing. With the start of the image formation processing, the photosensitive drum 65 rotates.

For example, the controller 649 counts up one or both of the number of sheets P subjected to the image formation processing and the number of rotations of the photosensitive drum 65.

The calculator 647 calculates the surface potential V0, for example, each time the image forming apparatus 1 subjects a predetermined number of sheets P to the image formation processing since the calculation of the reference surface potential. Specifically, when the number of sheets P subjected to the image formation processing is counted up to the predetermined number, the controller 649 controls the calculator 647 to allow the calculator 647 to calculate the surface potential V0.

Alternatively, the calculator 647 may calculate the surface potential each time the photosensitive drum 65 rotates a predetermined number of times since the calculation of the reference surface potential. Specifically, when the number of rotations of the photosensitive drum 65 is counted up to the predetermined number of times, the controller 649 controls the calculator 647 to allow the calculator 647 to calculate the surface potential.

When the calculator 647 calculates a surface potential V0 other than the reference surface potential, the controller 649 acquires the calculated surface potential as a current surface potential and determines, by comparison between the acquired current surface potential and the reference surface potential stored in the storage device 12, whether or not a transfer memory is occurring.

Specifically, if the current surface potential is smaller than the reference surface potential and the difference N1 thereof from the reference surface potential is larger than a predetermined value V1, the controller 649 determines that a transfer memory is occurring.

When determining that a transfer memory is occurring, the controller 649 sets the transfer current It at a smaller magnitude than the magnitude set during previous image formation processing. When the transfer current It is larger, a transfer memory more significantly occurs and the difference N1 from the reference surface potential becomes larger. Therefore, by lowering the transfer current It, the degree of decrease in the surface potential V0 can be reduced.

For example, when the difference N1 of the current surface potential from the reference surface potential is larger than a value V2 larger than the predetermined value V1, the controller 649 may not take control of lowering the transfer current It and may allow the liquid crystal display 21 to display a notification screen prompting the user to replace the photosensitive drum 65.

Although in this embodiment the controller 649 calculates each of the reference surface potential and the current surface potential in a single calculation, the present disclosure is not limited to this and, for example, the controller 649 may calculate each of the reference surface potential and the current surface potential multiple times and calculate the respective average values of them as the reference surface potential and the current surface potential. In doing so, the calculation of the reference surface potential and the current surface potential and the image formation processing may be repeated alternately.

Figure 5:
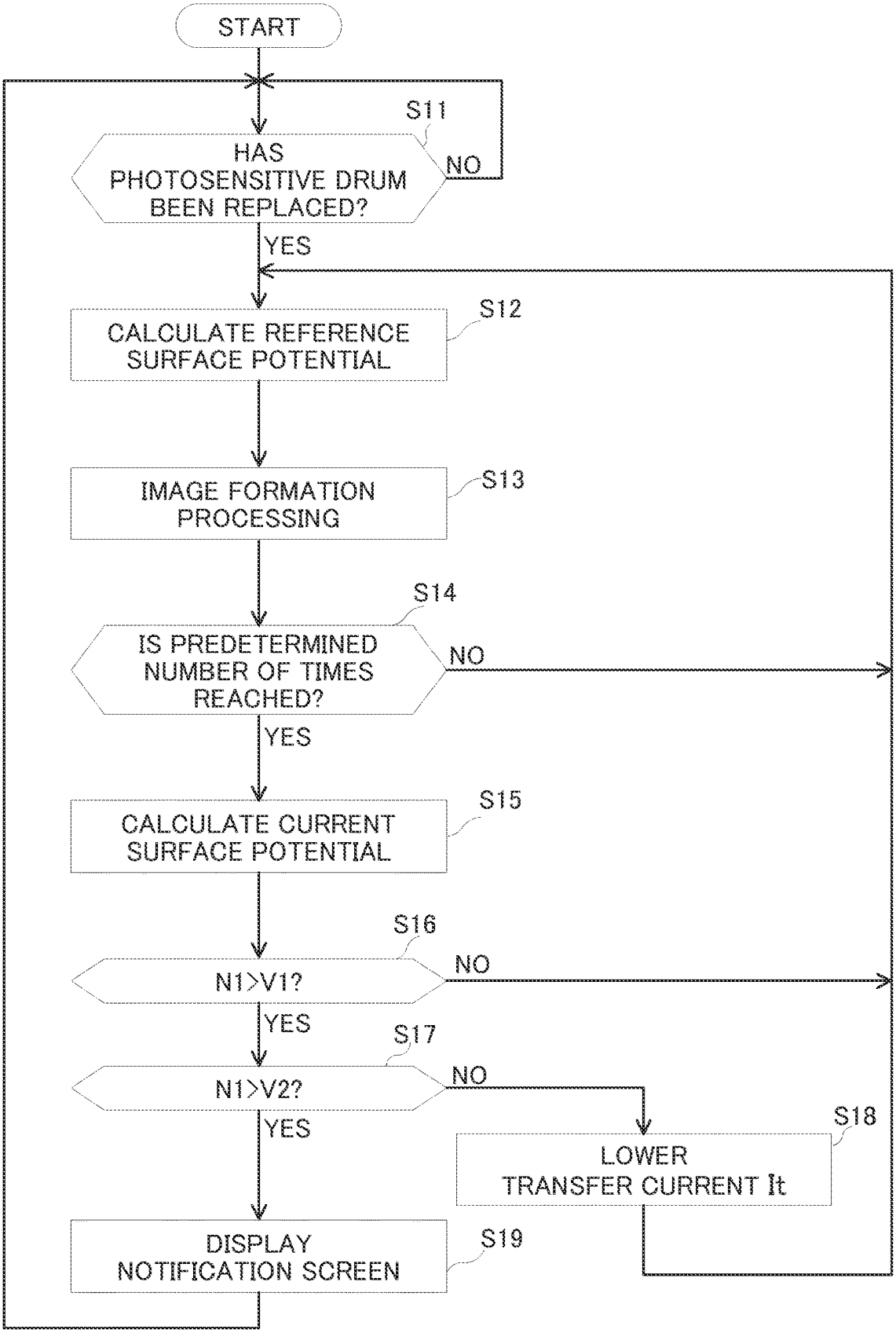
FIG. 5 is a flowchart showing a transfer memory determination process corresponding to a first determination method.

Next, a description will be given of a transfer memory determination process in this embodiment with reference to FIG. 5. FIG. 5 is a flowchart showing a transfer memory determination process corresponding to the first determination method.

In this embodiment, when the photosensitive drum 65 is replaced (Yes in step S11), the controller 649 sets a tentative transfer current, controls the calculator 647 to allow the calculator 647 to calculate the reference surface potential, and acquires and retains the reference surface potential calculated by the calculator 647 (step S12).

For example, in accordance with an input indicating an instruction to execute image formation processing from the user, the controller 649 controls the components of the image forming apparatus 1 to allow them to subject a plurality of sheets P to the image formation processing (step S13).

The controller 649 counts up one or both of the number of sheets P subjected to the image formation processing and the number of rotations of the photosensitive drum 65 (step S14). Until the number of sheets P subjected to the image formation processing reaches the predetermined number or the number of rotations of the photosensitive drum 65 reaches the predetermined number of times, the controller 649 controls the components of the image forming apparatus 1 to allow them to perform the image formation processing, for example, in accordance with an input from the user (No in step S14 and then step S13).

When the number of sheets P subjected to the image formation processing reaches the predetermined number or when the number of rotations of the photosensitive drum 65 reaches the predetermined number of times (Yes in step S14), the controller 649 sets a tentative transfer current, controls the calculator 647 to allow the calculator 647 to calculate the current surface potential, and acquires the current surface potential calculated by the calculator 647 (step S15).

The controller 649 compares the reference surface potential with the current surface potential (step S16). When the current surface potential is equal to or larger than the reference surface potential or when the current surface potential is smaller than the reference surface potential but the difference N1 from the reference surface potential is equal to or smaller than the predetermined value V1 (No in step S16), the controller 649 controls the components of the image forming apparatus 1 to allow them to perform the image formation processing, for example, in accordance with an input from the user (step S13).

On the other hand, when the current surface potential is smaller than the reference surface potential and the difference N1 from the reference surface potential is larger than the predetermined value V1 and equal to or smaller than the predetermined value V2 (Yes in step S16 and No in step S17), the controller 649 sets the transfer current It at a smaller magnitude than the magnitude set during previous image formation processing (step S18).

When the current surface potential is smaller than the reference surface potential and the difference N1 from the reference surface potential is larger than the predetermined value V2 (Yes in step S16 and Yes in step S17), the controller 649 allows the liquid crystal display 21 to display a notification screen prompting the user to replace the photosensitive drum 65 (step S19). The user replaces the photosensitive drum 65 in accordance with the screen displayed on the liquid crystal display 21 (Yes in step S11).

[Second Determination Method]

In this embodiment, the controller 649 may determine whether or not a transfer memory is occurring, based on the respective variation ranges of reference surface potential and current surface potential according to multiple levels of tentative transfer current.

Specifically, the controller 649 sets multiple levels of tentative transfer current when the calculator 647 calculates the surface potential V0.

The controller 649 controls the calculator 647 to allow the calculator 647 to calculate the respective surface potentials V0 according to the set tentative transfer currents. Under the control of the controller 649, the calculator 647 calculates the respective surface potentials V0 according to the tentative transfer currents.

Based on the surface potentials V0 calculated according to the tentative transfer currents by the calculator 647, the controller 649 calculates the variation range of surface potential V0 and allows the storage device 12 to store and retain the calculated variation range, for example, as a reference variation range.

For example, when the image forming apparatus 1 subjects the predetermined number of sheets P to image formation processing since the calculation of the reference variation range or when the photosensitive drum 65 rotates the predetermined number of times since the calculation of the reference variation range, the controller 649 controls the calculator 647 to allow the calculator 647 to calculate the respective current surface potentials according to the plurality of tentative transfer currents. Under the control of the controller 649, the calculator 647 calculates the respective current surface potentials according to the plurality of tentative transfer currents.

The controller 649 calculates the variation range of current surface potential based on the current surface potentials calculated according to the tentative transfer currents by the calculator 647.

The controller 649 determines whether or not a transfer memory is occurring by comparison of the calculated variation range of current surface potential with the reference variation range stored in the storage device 12.

Specifically, when the variation range of current surface potential is larger than the reference variation range and the difference N2 thereof from the reference variation range is larger than a predetermined value V3, the controller 649 determines that a transfer memory is occurring.

When determining that a transfer memory is occurring, the controller 649 sets the transfer current It at a smaller magnitude than the magnitude set during previous image formation processing. For example, when the difference N2 of the variation range of current surface potential from the reference variation range is larger than a value V4 larger than the predetermined value V3, the controller 649 may not take control of lowering the transfer current It and may allow the liquid crystal display 21 to display a notification screen prompting the user to replace the photosensitive drum 65.

Figure 6:
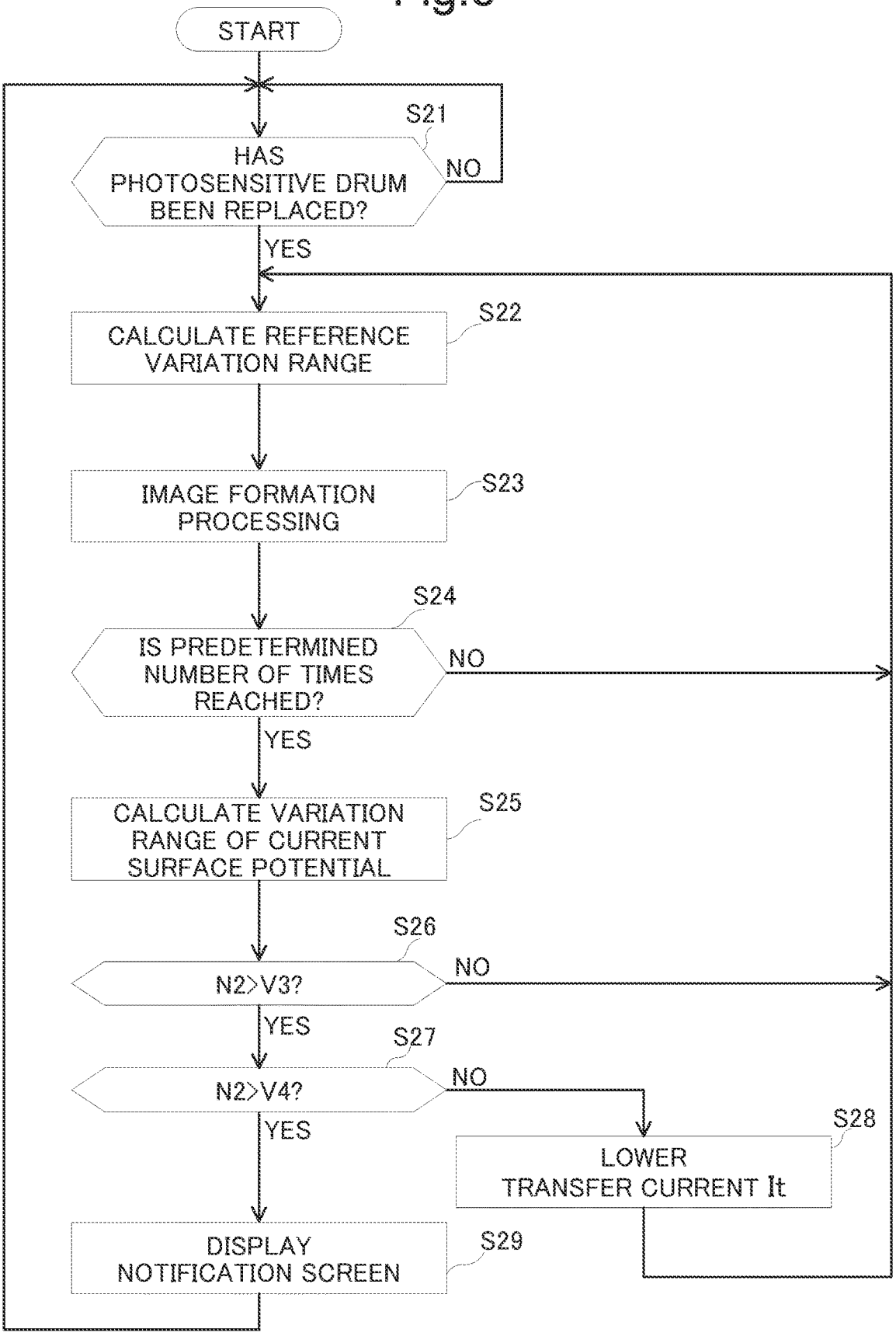
FIG. 6 is a flowchart showing a transfer memory determination process corresponding to a second determination method.

Next, a description will be given of another transfer memory determination process in this embodiment with reference to FIG. 6. FIG. 6 is a flowchart showing a transfer memory determination process corresponding to the second determination method in this embodiment.

In this embodiment, when the photosensitive drum 65 is replaced (Yes in step S21), the controller 649 sets a plurality of tentative transfer currents, controls the calculator 647 to allow the calculator 647 to calculate the respective surface potentials V0 according to the transfer currents, acquires the surface potentials V0 calculated by the calculator 647, calculates the variation range of surface potential V0, and retains the calculated variation range as the reference variation range (step S22).

For example, in accordance with an input indicating an instruction to execute image formation processing from the user, the controller 649 controls the components of the image forming apparatus 1 to allow them to subject a plurality of sheets P to the image formation processing (step S23).

The controller 649 counts up one or both of the number of sheets P subjected to the image formation processing and the number of rotations of the photosensitive drum 65 (step S24). Until the number of sheets P subjected to the image formation processing reaches the predetermined number or the number of rotations of the photosensitive drum 65 reaches the predetermined number of times, the controller 649 controls the components of the image forming apparatus 1 to allow them to perform the image formation processing, for example, in accordance with an input from the user (No in step S24 and then step S23).

When the number of sheets P subjected to the image formation processing reaches the predetermined number or when the number of rotations of the photosensitive drum 65 reaches the predetermined number of times (Yes in step S24), the controller 649 sets a plurality of tentative transfer currents, controls the calculator 647 to allow the calculator 647 to calculate the respective current surface potentials according to the plurality of tentative transfer currents, acquires the current surface potentials calculated by the calculator 647, and calculates the variation range of current surface potential (step S25).

The controller 649 compares the reference variation range with the variation range of current surface potential (step S26). When the variation range of current surface potential is equal to or smaller than the reference variation range or when the variation range of current surface potential is larger than the reference variation range but the difference N2 from the reference variation range is equal to or smaller than the predetermined value V3 (No in step S26), the controller 649 controls the components of the image forming apparatus 1 to allow them to perform the image formation processing, for example, in accordance with an input from the user (step S23).

On the other hand, when the variation range of current surface potential is larger than the reference surface potential and the difference N2 from the reference variation range is larger than the predetermined value V3 and equal to or smaller than the value V4 (Yes in step S26 and No in step S27), the controller 649 sets the transfer current It at a smaller magnitude than the magnitude set during previous image formation processing (step S28).

When the variation range of current surface potential is larger than the reference variation range and the difference N2 from the reference variation range is larger than the predetermined value V4 (Yes in step S26 and Yes in step S27), the controller 649 allows the liquid crystal display 21 to display a notification screen prompting the user to replace the photosensitive drum 65 (step S29). The user replaces the photosensitive drum 65 in accordance with the screen displayed on the liquid crystal display 21 (Yes in step S21).

Meanwhile, the electric current monitored in the above-described general technique is susceptible to, for example, changes over the years of the photo conductor, the charging member or so on and is therefore unstable and likely to have a margin of error, which is a problem. For this reason, there are concerns that the accuracy of the surface potential on the photo conductor may decrease.

In contrast, the above embodiment enables provision of an image forming apparatus 1 capable of obtaining the surface potential of the image carrier with high accuracy without the use of any expensive sensor, such as a surface potential sensor.

Example 1

Next, the present disclosure will be described more specifically with reference to an example, but the present disclosure is not limited by the following example.

In the example of the present disclosure, a multifunction peripheral was used as the image forming apparatus 1. The multifunction peripheral used was a modified machine of TASKalfa 2550ci (manufactured by KYOCERA Document Solutions Inc.).

The experimental conditions for the multifunction peripheral were as follows:

Photosensitive drum 65: amorphous silicon (a-Si) drum

Film thickness of photosensitive drum 65: 20 μm

Charging device 63: 6 mm outer diameter of charging roller core, 3 mm rubber thickness, 6.0 log ohm rubber resistance Charging bias: DC only Blade 645: SUS430 magnetized Thickness of blade 645: 1.5 mm Surface profile of developing roller 641: knurled and blasted Outer diameter of developing roller 641: 20 mm Recesses in developing roller 641: 80 rows in the circumferential direction Rate of circumferential velocity of developing roller 641 to circumferential velocity of photosensitive drum 65: 1.8

Distance between developing roller 641 and photosensitive drum 65: 0.30 mm AC component of bias voltage: 1200 Vpp, 50% duty, 8 kHz square wave Toner: 6.8 μm particle diameter, positively charged Carrier: 38 μm particle diameter, ferrite/resin-coated carrier Toner concentration: 6%

Print rate: 55 sheets per minute

Next, a description will be given of the surface potential calculated in the image forming apparatus 1 according to this example with reference to FIGS. 7 and 8.

FIG. 7 is a table showing development currents measured when two levels of bias voltage have been applied to the developing roller 641 in the image forming apparatus 1 according to this example.

Figure 8:
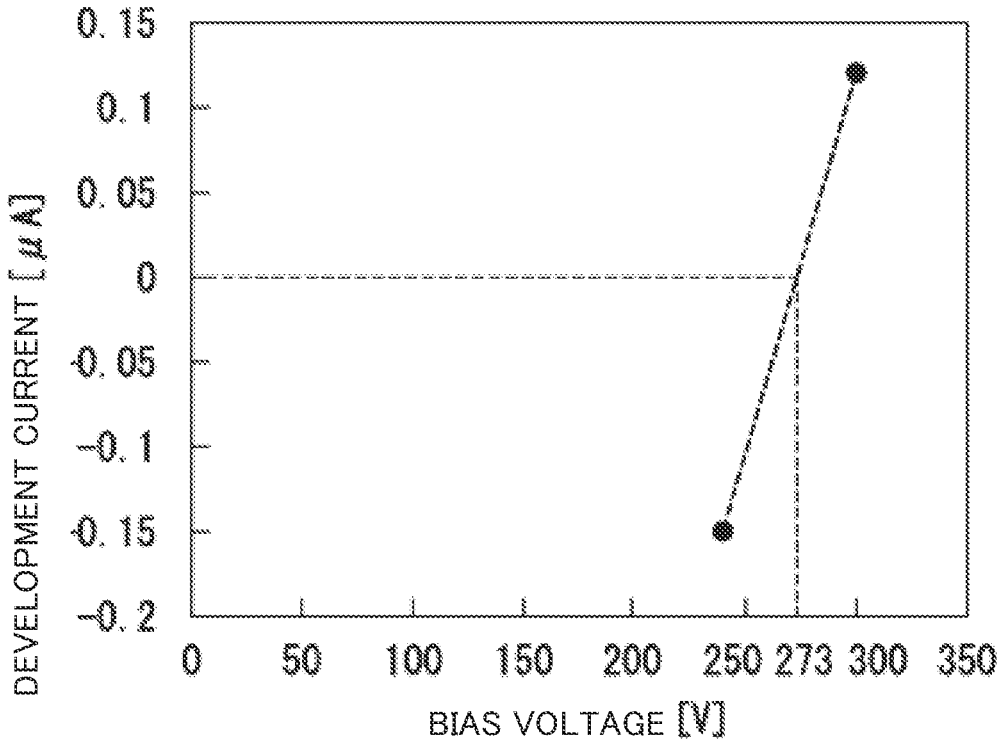
FIG. 8 is a graph showing a relationship between the bias voltage and the development current shown in FIG. 7.

FIG. 8 is a graph showing a relationship between the bias voltage and the development current shown in FIG. 7. In FIG. 8, the development current is put on the vertical axis and the bias voltage is put on the horizontal axis.

In this example, when the bias voltage was 240 [V], the development current was −0.15 [μA] (LEVEL 1). When the bias voltage was 300 [V], the development current was 0.12 [μA] (LEVEL 2).

As shown in FIG. 8, in the image forming apparatus 1 according to this example, the surface potential is calculated as 273 [V].

Next, a description will be given of surface potentials calculated in the image forming apparatus 1 according to this example with reference to FIGS. 9 and 10. FIG. 9 is a table showing changes with time of the surface potential of a photosensitive drum 65A in the image forming apparatus 1 according to this example.

FIG. 9 shows the respective reference surface potentials of the photosensitive drum 65A, the respective surface potentials thereof after image formation processing for 50000 sheets, and the respective surface potentials after image formation processing for 100000 sheets when the tentative transfer current was set at 18 μA, 22 μA, and 26 μA.

Specifically, the reference surface potential of the photosensitive drum 65A was 300 [V] at a tentative transfer current of 18 μA, 300 [V] at a tentative transfer current of 22 μA, and 290 [V] at a tentative transfer current of 26 μA.

The surface potential after image formation processing for 50000 sheets was 300 [V] at a tentative transfer current of 18 μA, 285 [V] at a tentative transfer current of 22 μA, and 275 [V] at a tentative transfer current of 26 μA.

The surface potential after image formation processing for 100000 sheets was 300 [V] at a tentative transfer current of 18 μA, 280 [V] at a tentative transfer current of 22 μA, and 265 [V] at a tentative transfer current of 26 μA.

[Determination of Photosensitive Drum 65A by First Determination Method]

A description will be given below of the case where whether or not a transfer memory is occurring is determined by the first determination method after the image formation processing for 50000 sheets. When the tentative transfer current is 18 μA, the amount of change in the surface potential from the reference surface potential is 0 [V], in which case it is determined that no transfer memory is occurring. When the tentative transfer current is 22 μA, the amount of change in the surface potential from the reference surface potential is 15 [V] smaller than a predetermined value of 20 [V], in which case it is determined that no transfer current has occurred. When the tentative transfer current is 26 μA, the amount of change in the surface potential from the reference surface potential is 15 [V] smaller than the predetermined value, 20 [V], in which case it is determined that no transfer current is occurring.

A description will be given below of the case where whether or not a transfer memory is occurring is determined by the first determination method after the image formation processing for 100000 sheets. When the tentative transfer current is 18 μA, the amount of change in the surface potential from the reference surface potential is 0 [V], in which case it is determined that no transfer memory is occurring. When the tentative transfer current is 22 μA, the amount of change in the surface potential from the reference surface potential is 20 [V] equal to the predetermined value, 20 [V], in which case it is determined that no transfer current is occurring. When the tentative transfer current is 26 μA, the amount of change in the surface potential from the reference surface potential is 25 [V] larger than the predetermined value, 20 [V], in which case it is determined that a transfer current is occurring.

If it is determined that a transfer memory is occurring, the setting for the transfer current It is changed to lower the transfer current It. In this example, if the transfer current It is 22 μA, for example, the transfer current It is changed to 20 μA in image formation processing after the image formation processing for 100000 sheets.

[Determination of Photosensitive Drum 65A by Second Determination Method]

A description will be given below of the case where whether or not a transfer memory is occurring is determined by the second determination method. The variation range of reference surface potential (the reference variation range) is 10 [V] and the variation range of surface potential after the image formation processing for 50000 sheets is 25 [V]. Therefore, the amount of change in the variation range from the reference variation range is 15 [V] smaller than a predetermined value of 20 [V], in which case it is determined that no transfer memory is occurring.

The variation range of surface potential after the image formation processing for 100000 sheets is 35 [V]. Therefore, the amount of change in the variation range from the reference variation range is 25 [V] larger than the predetermined value, 20 [V], in which case it is determined that a transfer memory is occurring.

If it is determined that a transfer memory is occurring, the setting for the transfer current It is changed to lower the transfer current It. For example, the transfer current It is changed from 22 μA to 20 μA in image formation processing after the image formation processing for 100000 sheets.

FIG. 10 is a table showing changes with time of the surface potential of another photosensitive drum 65B of the same type as the photosensitive drum 65A. FIG. 10 shows the results of the same measurement as in FIG. 9 to which the photosensitive drum 65B was subjected.

The reference surface potential of the photosensitive drum 65B was 300 [V] at a tentative transfer current of 18 μA, 300 [V] at a tentative transfer current of 22 μA, and 290 [V] at a tentative transfer current of 26 μA.

The surface potential after image formation processing for 50000 sheets was 300 [V] at a tentative transfer current of 18 μA, 270 [V] at a tentative transfer current of 22 μA, and 255 [V] at a tentative transfer current of 26 μA.

The surface potential after image formation processing for 100000 sheets was 300 [V] at a tentative transfer current of 18 μA, 260 [V] at a tentative transfer current of 22 μA, and 235 [V] at a tentative transfer current of 26 μA.

[Determination of Photosensitive Drum 65B by First Determination Method]

A description will be given below of the case where whether or not a transfer memory is occurring is determined by the first determination method after the image formation processing for 50000 sheets. When the tentative transfer current is 18 μA, the amount of change in the surface potential from the reference surface potential is 0 [V], in which case it is determined that no transfer memory is occurring. When the tentative transfer current is 22 μA, the amount of change in the surface potential from the reference surface potential is 30 [V] larger than the predetermined value, 20 [V], in which case it is determined that a transfer current is occurring. When the tentative transfer current is 26 μA, the amount of change in the surface potential from the reference surface potential is 35 [V] larger than the predetermined value, 20 [V], in which case it is determined that a transfer current is occurring.

A description will be given below of the case where whether or not a transfer memory is occurring is determined by the first determination method after the image formation processing for 100000 sheets. When the tentative transfer current is 18 μA, the amount of change in the surface potential from the reference surface potential is 0 [V], in which case it is determined that no transfer memory is occurring. When the tentative transfer current is 22 μA, the amount of change in the surface potential from the reference surface potential is 40 [V] larger than the predetermined value, 20 [V], in which case it is determined that a transfer current is occurring. When the tentative transfer current is 26 μA, the amount of change in the surface potential from the reference surface potential is 55 [V] larger than the predetermined value, 20 [V], in which case it is determined that a transfer current is occurring.

If it is determined that a transfer memory is occurring, the setting for the transfer current It is changed to lower the transfer current It. For example, the transfer current It is changed from 22 μA to 20 μA in image formation processing after the image formation processing for 50000 sheets.

Furthermore, after the image formation processing for 100000 sheets, the amount of change in the surface potential from the reference surface potential is larger than a predetermined value of 50 [V]. Therefore, without any change in the setting for the transfer current It, the user is prompted to replace the photosensitive drum 65B.

[Determination of Photosensitive Drum 65B by Second Determination Method]

A description will be given below of the case where whether or not a transfer memory is occurring is determined by the second determination method. The variation range of reference surface potential (the reference variation range) is 10 [V] and the variation range of surface potential after the image formation processing for 50000 sheets is 45 [V]. Therefore, the amount of change in the variation range from the reference variation range is 35 [V] larger than the predetermined value, 20 [V], in which case it is determined that a transfer memory is occurring.

The variation range of surface potential after the image formation processing for 100000 sheets is 65 [V]. Therefore, the amount of change in the variation range from the reference variation range is 55 [V] larger than the predetermined value, 20 [V], in which case it is determined that a transfer memory is occurring.

If it is determined that a transfer memory is occurring, the setting for the transfer current It is changed to lower the transfer current It. For example, the transfer current It is changed from 22 μA to 20 μA in image formation processing after the image formation processing for 50000 sheets.

Furthermore, after the image formation processing for 100000 sheets, the amount of change in the variation range from the reference variation range is larger than the predetermined value, 50 [V]. Therefore, without any change in the setting for the transfer current It, the user is prompted to replace the photosensitive drum 65B.

Although in this example the difference in bias voltage applied was 60 V at maximum, it is not limited to this and may be 100 V at maximum. However, the difference in bias voltage applied is preferably about 50 V.

Although in this example the photosensitive drum 65 was amorphous silicon drum, it is not limited to this and may be a positively charged organic photosensitive drum. When an amorphous silicon drum is used as the photosensitive drum 65, the dielectric constant of the photosensitive layer is higher than the positively changed organic photosensitive drum, the electric current more easily flows, and the carrier resistance value is smaller. Therefore, the measurement accuracy is increased.

Although in this example a two-component developer was used, the developer to be used is not limited to this and may be any monocomponent developer.

The embodiment of the present disclosure has thus far been described with reference to the drawings (FIGS. 1 to 10). However, the present disclosure is not limited to the above embodiment and can be implemented in various forms without departing from the gist of the present disclosure. For the sake of ease of understanding, the drawings are schematically given by mainly showing components. The thickness of each component, the length thereof, the number of components, and so on shown in the drawings are different from those of actual components for convenience of creation of the drawings. The materials, shapes, sizes, and so on of the components described in the above embodiment are merely illustrative, not particularly limited, and can be changed variously without substantially departing from the effects of the present disclosure.

INDUSTRIAL APPLICABILITY

The present disclosure is applicable to the field of image forming apparatuses.

While the present disclosure has been described in detail with reference to the embodiments thereof, it would be apparent to those skilled in the art the various changes and modifications may be made therein within the scope defined by the appended claims.

What is claimed is:

1. An image forming apparatus comprising:

an image carrier that allows an electrostatic latent image to be formed on a surface thereof;

a charging device that charges the image carrier;

a developing device that supplies a toner on the image carrier and develops the electrostatic latent image formed on the image carrier to form a toner image;

a transfer device that transfers the toner image formed by the developing device to a recording medium;

a development power supply that applies at least one predetermined bias voltage to the developing device;

a current measurement device that measures a development current flowing through the developing device; and a processor that executes a control program to function as:

(i) a calculator that calculates a surface potential of the image carrier based on the development current measured by the current measurement device; and (ii) a controller that controls the charging device, the developing device, the transfer device, and the development power supply, the controller setting a tentative transfer current to be flowed through the transfer device while the calculator calculates the surface potential, wherein, based on the surface potential calculated by the calculator, the controller sets a transfer current to be flowed through the transfer device during image formation processing in which the image forming apparatus forms an image on the recording medium.

2. The image forming apparatus according to claim 1, wherein the calculator calculates the surface potential at predetermined time intervals, the controller selects, as a reference surface potential, one of a plurality of surface potentials calculated by the calculator, and when the surface potential more recently calculated than the reference surface potential is smaller than the reference surface potential and a difference of the surface potential from the reference surface potential is larger than a predetermined first value, the controller sets the transfer current at a smaller magnitude than the magnitude of the transfer current set during the image formation processing previously executed.

3. The image forming apparatus according to claim 2, further comprising a display device, wherein when the surface potential more recently calculated than the reference surface potential is smaller than the reference surface potential and the difference of the surface potential from the reference surface potential is larger than a predetermined second value larger than the first value, the controller allows the display device to display a notification screen prompting to replace the image carrier.

4. The image forming apparatus according to claim 1, wherein the controller sets the tentative transfer current at a value larger than a value of a transfer current during normal image formation processing.

5. The image forming apparatus according to claim 1, wherein the controller sets multiple levels of the tentative transfer current at predetermined time intervals, the calculator calculates respective surface potentials according to the multiple levels of the tentative transfer current, the controller calculates variation ranges of the surface potentials based on the respective surface potentials calculated by the calculator, the controller selects, as a reference variation range, one of a plurality of the variation ranges calculated at the predetermined time intervals, and when the variation range more recently calculated than the reference variation range is larger than the reference variation range and a difference of the variation range from the reference variation range is larger than a predetermined third value, the controller sets the transfer current at a smaller magnitude than the magnitude of the transfer current set during the image formation processing previously executed.

6. The image forming apparatus according to claim 5, further comprising a display device, wherein when the variation range more recently calculated than the reference variation range is larger than the reference variation range and the difference of the variation range from the reference variation range is larger than a predetermined fourth value larger than the third value, the controller allows the display device to display a notification screen prompting to replace the image carrier.

7. The image forming apparatus according to claim 1, wherein the calculator calculates the surface potential each time a predetermined number of the recording media are subjected to the image formation processing.

8. The image forming apparatus according to claim 1, wherein the calculator calculates the surface potential each time the image carrier rotates a predetermined number of times.

9. The image forming apparatus according to claim 1, wherein the development power supply applies predetermined bias voltages to the developing device, the current measurement device measures the respective development currents according to the predetermined bias voltages, and the calculator calculates surface potentials based on the respective development currents.

10. The image forming apparatus according to claim 1, wherein the calculator calculates the surface potential in a time between the image formation processing and the image formation processing to be executed next.

* * * * *